US006510612B1

(12) United States Patent
Cybulski

(10) Patent No.: US 6,510,612 B1
(45) Date of Patent: Jan. 28, 2003

(54) KNIFE

(76) Inventor: Marian Cybulski, 206 Oakridge Dr., Toronto, Ontario (CA), M1M 2B3

( * ) Notice: Subject to any disclaimer, the term of this patent is extended or adjusted under 35 U.S.C. 154(b) by 0 days.

(21) Appl. No.: 09/902,166

(22) Filed: Jul. 11, 2001

(51) Int. Cl.[7] ..... B26B 1/08
(52) U.S. Cl. ..... 30/162; 30/335
(58) Field of Search ..... 30/162, 335, 336, 30/337, 329

(56) References Cited

U.S. PATENT DOCUMENTS

| | | | | |
|---|---|---|---|---|
| 3,448,518 A | * | 6/1969 | Sklar | 30/162 |
| 4,170,062 A | * | 10/1979 | Machida | 30/162 |
| 4,196,515 A | | 4/1980 | Sugiyama | 30/162 |
| D324,475 S | | 3/1992 | Staubitz et al. | D8/99 |
| 5,269,063 A | | 12/1993 | Okada | 30/162 |
| D347,563 S | | 6/1994 | Okada | D8/99 |
| D386,959 S | | 12/1997 | Okada | D8/99 |
| D392,173 S | | 3/1998 | Okada | D8/99 |
| D398,829 S | | 9/1998 | Okada | D8/99 |
| D399,114 S | | 10/1998 | Okada | D8/99 |
| D431,170 S | | 9/2000 | Okada | D8/99 |
| 6,226,873 B1 | * | 5/2001 | Okumura | 30/162 |

FOREIGN PATENT DOCUMENTS

GB 1522454 * 8/1978

* cited by examiner

*Primary Examiner*—Hwei-Siu Payer
(74) *Attorney, Agent, or Firm*—Dimock Stratton Clarizio LLP; Mark B. Eisen

(57) ABSTRACT

A utility knife having a quick release feature, whereby a resilient blade engaging member biased to the locked position engages an opening in the blade, and when the blade engaging member is pushed against the end of a guide slot it automatically releases from the blade allowing the blade to be removed from the knife handle. The knife handle structure reinforces the throat of the knife, by providing a double channel configuration comprising an outer channel with a blade retaining surface and an inner channel inverted relative to the outer channel and providing a blade supporting surface. The outer channel is tapered toward the inner channel about the throat of the knife, to reinforce the throat and prevent deformation under the stresses imparted by the knife blade when in use.

14 Claims, 4 Drawing Sheets

KNIFE

FIELD OF THE INVENTION

This invention relates to knives. In particular, this invention relates to a retractable utility knife with improved blade support and blade replacement features.

BACKGROUND OF THE INVENTION

Utility knives are used in a variety of commercial and domestic applications, including construction, household repairs, arts and crafts and many others. Utility knives provide the advantage of being extremely sharp, and are typically loaded with a blade which is scored into segments, so that as the tip of the blade becomes dull the end segment can be broken off and the user can continue using the knife by exposing the next successive segment, which is still sharp.

However, utility knives present a number of disadvantages, particularly in heavy duty applications such as construction. Eventually, when the last segment has been broken off of the blade, the blade must be replaced. Conventionally, this requires removing the sliding body which retains the blade in the knife handle, attaching a new blade, and replacing the sliding body into the knife handle. This can be a difficult operation to perform without a surface to rest the knife on (for example while on a ladder), and increases opportunities for injury because of the manipulation required in order to hold the blade on the sliding body while inserting it into the knife handle.

Moreover, in heavy duty applications there is a considerable amount of force experienced by the blade, for example when cutting wallboard and other surfacing materials, which tends to deflect the blade laterally. The primary resistance to deflection of the blade within the handle is provided by the throat of the handle, which conventionally provides a single layer of supporting surface (generally metallic) on each side of the blade. Accordingly, over time the cutting force on the blade tends to widen the throat of the knife handle, which in turn allows the blade to deflect more when in use. This results in inaccurate cuts and the blade segments breaking off prematurely.

It would accordingly be advantageous to provide a utility knife with a quick release feature which allows the blade to be changed without removing the sliding body from the knife handle and with minimal manipulation. It would further be advantageous to provide a knife structure which reinforces the throat of the knife, thereby reducing deflection of the blade during use and thus minimizing opportunities for inaccurate cuts and premature breakage of the blade.

SUMMARY OF THE INVENTION

The present invention provides a utility knife having a quick release feature, whereby forcing the sliding body toward the throat of the knife handle releases the blade, so that a new blade can be inserted easily and without removing the sliding body from the knife handle.

The invention accomplishes this by providing a resilient blade engaging member, biased to the locked position, which engages an opening in the blade in normal use. When the blade engaging member is pushed against the end of the guide slot in which the sliding body travels, it automatically releases from the blade allowing the blade to be removed from the knife handle and a new blade positioned and engaged therein.

The present invention further provides a knife handle structure which reinforces the throat of the knife, to better restrain the knife blade against deflection and thus to prolong the life of the knife blade and facilitate the accuracy of cutting with the knife.

The invention accomplishes this by providing a knife handle having a double channel configuration, comprising an outer channel providing a blade retaining surface and an inner channel inverted relative to the outer channel and providing a supporting surface for the blade. In the preferred embodiment the outer channel is tapered toward the inner channel about the throat of the knife, to reinforce the throat and prevent deformation under the stresses imparted by the knife blade when in use.

The present invention thus provides a knife, comprising a handle, comprising an outer channel having a back surface, side surfaces and retaining flanges depending inwardly from the side surfaces, an inner channel comprising blade supporting surface and sides, the sides abutting the side surfaces of the outer channel and the blade supporting surface being spaced from the retaining flanges for slidably receiving a blade therebetween, and a sliding body for engaging the blade trapped between the retaining flanges and the blade supporting surface, the sliding body having a locking member for locking a position of the sliding body within the handle.

In further aspects of the invention, the inner channel is disposed in inverted relation to the outer channel; a portion of the back surface of the outer channel tapers toward the blade supporting surface and abuts the blade supporting surface at a throat of the knife; the locking member comprises a locking bolt extending through the sliding body and through a guide slot in the blade supporting surface and into a nut trapped between the sides of the inner channel; the blade engaging member comprises a blade engaging member for engaging the blade to the sliding body, the blade engaging member comprising a body portion and a resilient blade engaging arm projecting from the body portion, the blade engaging arm having a blade engaging projection for extending through an opening in the blade, and a cam finger extending through the guide slot disposed between the blade engaging projection and an end of the guide slot adjacent to a throat of the knife, whereby when the sliding body is moved so that the blade engaging finger is pressed against the end of the guide slot the blade engaging projection recedes from the opening in the blade to disengage the blade from the sliding body; the back surface of the outer channel comprises an opening through which the cam finger extends when the blade engaging projection recedes from the opening in the blade; and/or a pocket clip is affixed to an opening in the blade supporting surface and covers an end of the handle opposite the throat of the knife.

The present invention in a further embodiment provides a knife, comprising a handle, comprising an outer channel having a back surface, side surfaces and retaining flanges depending inwardly from the side surfaces, a blade supporting surface having a guide slot, spaced from the retaining flanges for slidably receiving a blade therebetween, and a sliding body trapped between the retaining flanges and the blade supporting surface, the sliding body having a locking member disposed through the guide slot for locking a position of the sliding body within the handle, and comprising a blade engaging member for engaging the blade to the sliding body, the blade engaging member comprising a body portion, and a resilient blade engaging arm projecting from the body portion, the blade engaging arm having a blade engaging projection for extending through an opening in the blade, and a cam finger extending through. The guide slot, disposed between the blade engaging projection and an end of the guide slot adjacent to a throat of the knife, whereby when the sliding body is moved so that the blade engaging finger is pressed against the end of the guide slot, the blade engaging projection recedes from the opening in the blade to disengage the blade from the sliding body.

In further aspects of the further embodiment of the invention, a portion of the back surface of the outer channel tapers toward the blade supporting surface and abuts the blade supporting surface at a throat of the knife; the back surface of the outer channel comprises an opening through which the cam finger extends when the blade engaging projection recedes from the opening in the blade; the blade supporting surface is part of an inner channel is disposed in the outer channel; the inner channel is disposed in inverted relation to the outer channel; the locking member comprises a locking bolt extending through the sliding body and through a guide slot in the blade supporting surface and into a nut trapped between the sides of the inner channel; and/or a pocket clip is affixed to an opening in the blade supporting surface and covers an end of the handle opposite the throat of the knife.

BRIEF DESCRIPTION OF THE DRAWINGS

In drawings which illustrate by way of example only a preferred embodiment of the invention.

DETAILED DESCRIPTION OF THE INVENTION

Figure 1:
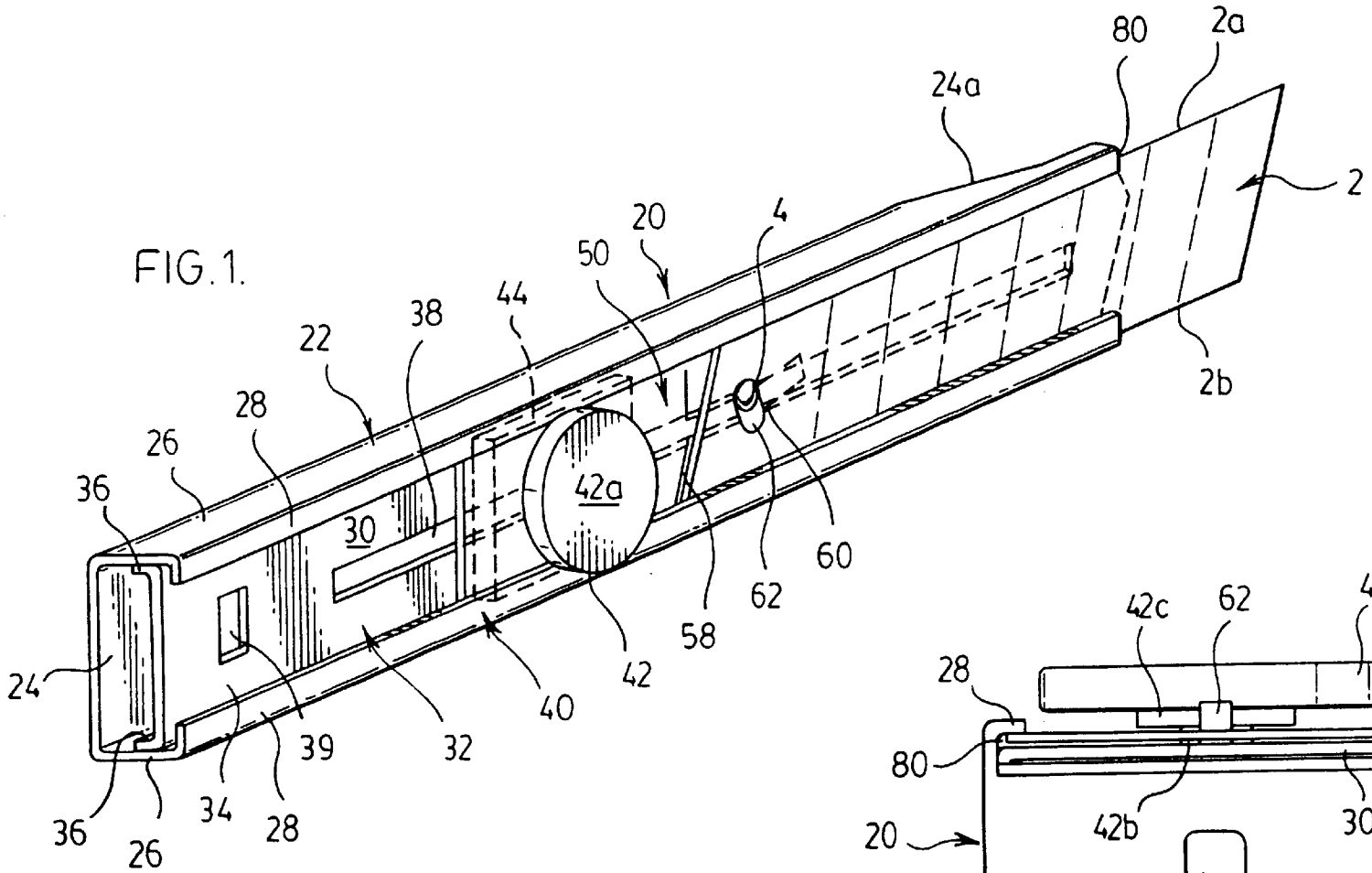
FIG. 1 is a perspective view showing the utility knife according to the invention in a partially opened condition.

FIG. 1 illustrates a preferred embodiment of the utility knife 10 according to the invention. The utility knife comprises a handle 20, a blade support 30, a sliding body 40 for retaining the blade 2 and locking the blade 2 at a desired position within the handle 20, and a locking element 50 which engages the blade 2 to the sliding body 40.

In the preferred embodiment, the handle 20 comprises an outer channel 22 having a back face 24, side faces 26 and inwardly depending flanges 28 which retain the blade 2 in the handle 20 and conceal the cutting edge 2*a* and spine 2*b* of the blade 2 when the blade 2 is retracted into the handle 20.

Figure 4:
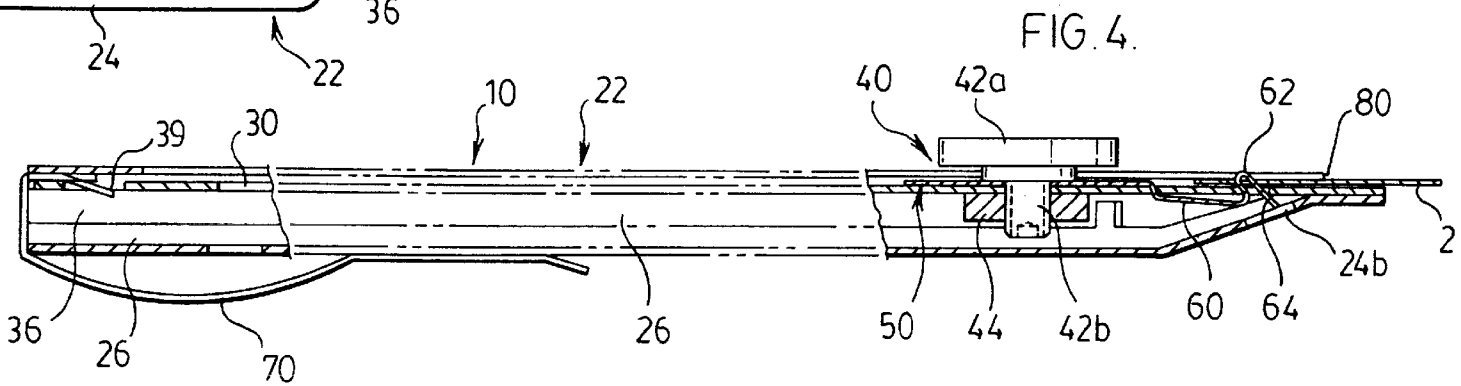
FIG. 4 is a cross sectional side elevation of the utility knife of FIG. 1.

Disposed within the outer channel 22 is a blade support surface 30, spaced from the retaining flanges 28 with sufficient clearance to allow the blade 2 and blade engaging member 50 (described below) to slide freely within the space defined between the retaining flanges 28 and the blade support surface 30, while providing substantial support for the blade 2 against lateral shimmying and deflection while in use. In the preferred embodiment the blade support surface 30 is formed by an inner channel 32 having a front face 34 and sides 36 which can be welded, soldered or otherwise suitably affixed to the outer channel 22. The blade supporting surface 30 further comprises a guide slot 38 defining a path of travel for the sliding body 40, and optionally an opening 39 for receiving a pocket clip 70 (omitted from FIG. 1 for clarity, shown in FIG. 4).

The sliding body 40 comprises a blade engaging member 50, described below, and a locking member comprising a locking bolt 42 having a rotary knob 42*a* and stem 42*b* (seen in FIGS. 4 to 6) extending through the guide slot 38 into a nut 44 trapped within the sides 36 of the inner channel 32 or otherwise suitably trapped within the outer channel 22 to prevent rotation of the nut 44. The stem 42*b* of the locking bolt 42 extends through the body 52 of the blade engaging member 50, through the guide slot 38 and into the nut 44, to restrict movement of the sliding body 40 to within the limits of the guide slot 38.

Figure 7:
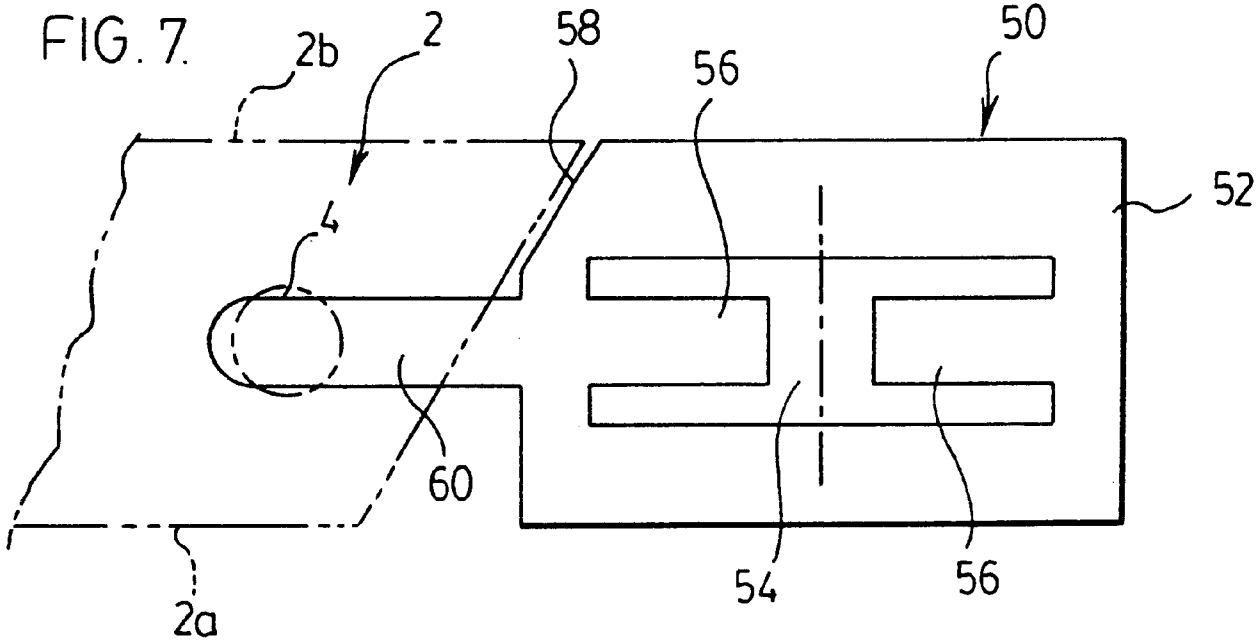
FIG. 7 is a plan view of the blade engaging member.
Figure 8:
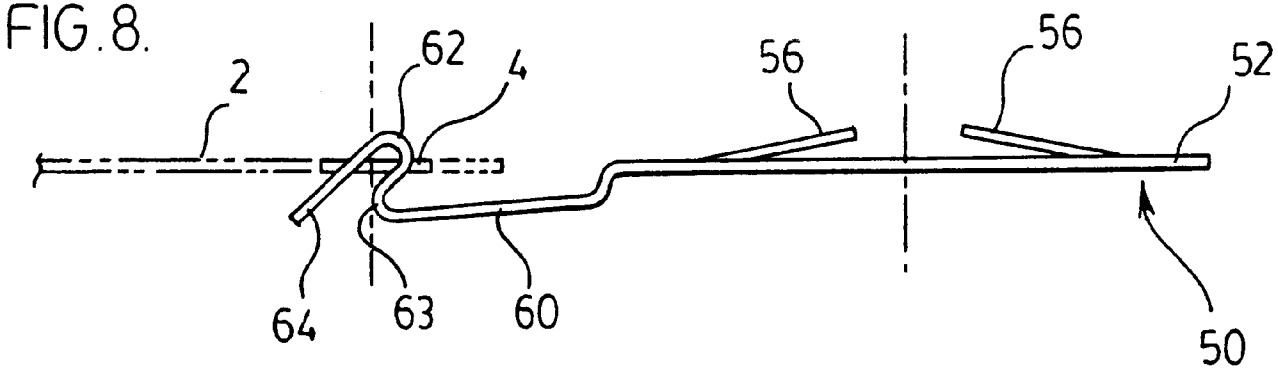
FIG. 8 is an elevational view of the blade engaging member.

The blade 2 is engaged to the sliding body 40 by the blade engaging member 50, illustrated in FIGS. 7 and 8. A body portion 52 is provided with an opening 54 through which the stem 42*b* of the locking bolt 42 extends. Preferably spring flanges 56 are provided on either side of the opening 54, splayed slightly away from the body 52 so as to push against a hub 42*c* of the rotary knob 42*a* and thus force the body portion 52 against the blade supporting surface 30, to prevent the sliding body 40 from shimmying within the handle 20. The body portion 52 is formed wide enough to be trapped between the flanges 28 and the blade supporting surface 30, and is preferably approximately the same thickness as the blade 2.

Figure 2:
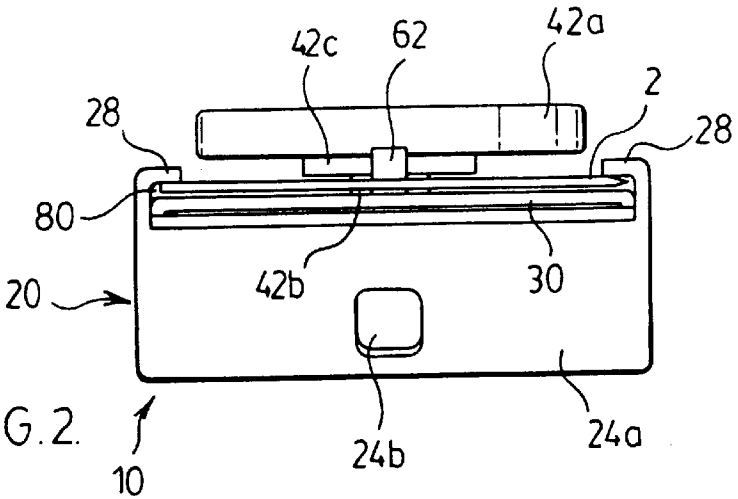
FIG. 2 is a front elevational view of the utility knife of FIG. 1.
Figure 3:
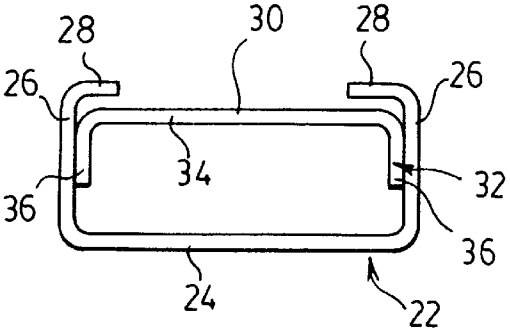
FIG. 3 is a rear elevation of the handle in the utility knife of FIG. 1.

A locking arm 60 which fits through the slot 38 extends forwardly of the body portion 52, and provides an engaging projection 62, for example in the form of a loop. The engaging projection 62 projects in the direction of the blade 2, and projects beyond the body portion 52 to bias the blade engaging member 50 to the locked position in which the engaging portion 62 extends through an opening 4 in the blade 2, The engaging projection 62 also preferably extends from the arm 60 in a direction away from the throat 80 of the knife 10, so as to resist a longitudinal force pulling the blade 2 out of the handle 20. The engaging portion 62 terminates in a cam finger 64, for releasing the blade 2 in the manner described below. Preferably the entire blade engaging member 50 is stamped as an integral piece from spring steel, or another suitable resilient material The throat 80 of the utility knife 10, best seen in FIG. 2, comprises the inwardly depending blade retaining flanges 28 of the outer channel 22, the blade supporting surface 30 and a tapered portion 24*a* of the rear surface 24 of the outer channel 22, which tapers toward the throat 80 and abuts the blade supporting surface 30. This provides additional reinforcement to the front face 34 of the inner channel 32 along the portion which experiences the most lateral stress when the knife 10 is in use, and thus resists widening of the throat 80 (i.e. deformation of the blade supporting surface 30 which increases its spacing from the blade retaining flanges 28), which tends to lower the useful life of the blade 2 by causing premature breakage, and reduces the accuracy of cutting. The tapered portion 24*a* of the outer channel provides an opening 24*b* through which the locking arm 60 and cam surface 64 project when the blade engaging member 50 is in the unlocked position shown in FIG. 6, as described below. The front face 34 of the inner channel 32 may extend beyond the throat 80 to provide additional support against deflection of the blade 2, and to provide an edge which facilitates breaking off of dull the blade segments.

In a storage condition, the sliding body 40 is locked at a position where the blade 2 is retracted into the handle 20. To use the utility knife 10 the user grasps the rotary knob 42*a* and turns it to loosen the bolt 42 and release the sliding body 40, and slides the sliding body 40 toward the throat 80. Edge 58 of the blade engaging member 50 pushes against the concealed end of the blade 2, to force the blade 2 out of the handle 20 and expose the end segment of the blade 2. The user rotates the rotary knob 42*a* in the other direction to tighten the bolt 42 and lock the sliding body 40, and can then use the knife 10 with the blade 2 locked in position. The reinforcing strength provided by the tapered portion 24*a* of the outer channel 22 against the blade supporting surface 30 at the throat 80 of the knife 10 helps to maintain the blade 2 secure against shimmying and lateral deflection while the knife 10 is in use.

Figure 5:
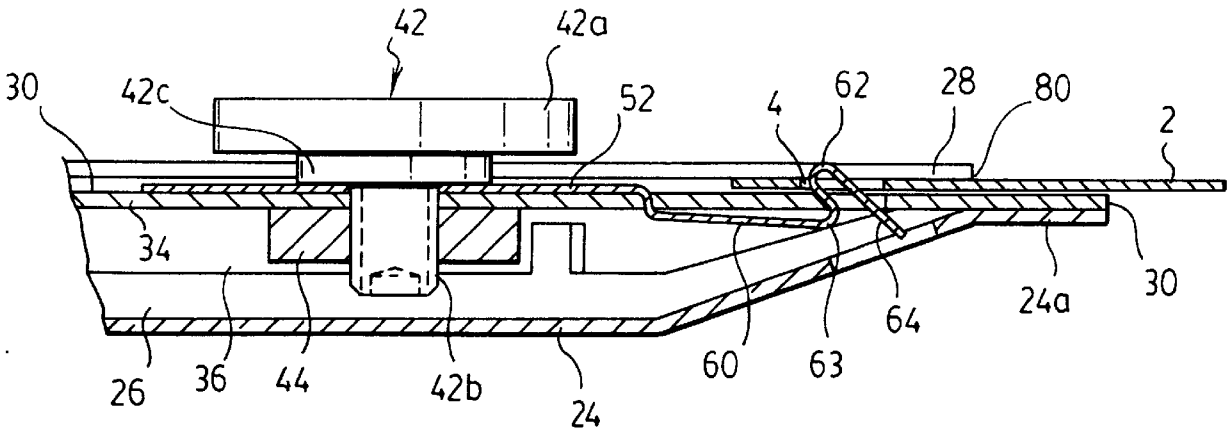
FIG. 5 is an enlarged partial cross section of the utility knife of FIG. 1 showing the sliding body position for release of the blade.
Figure 6:
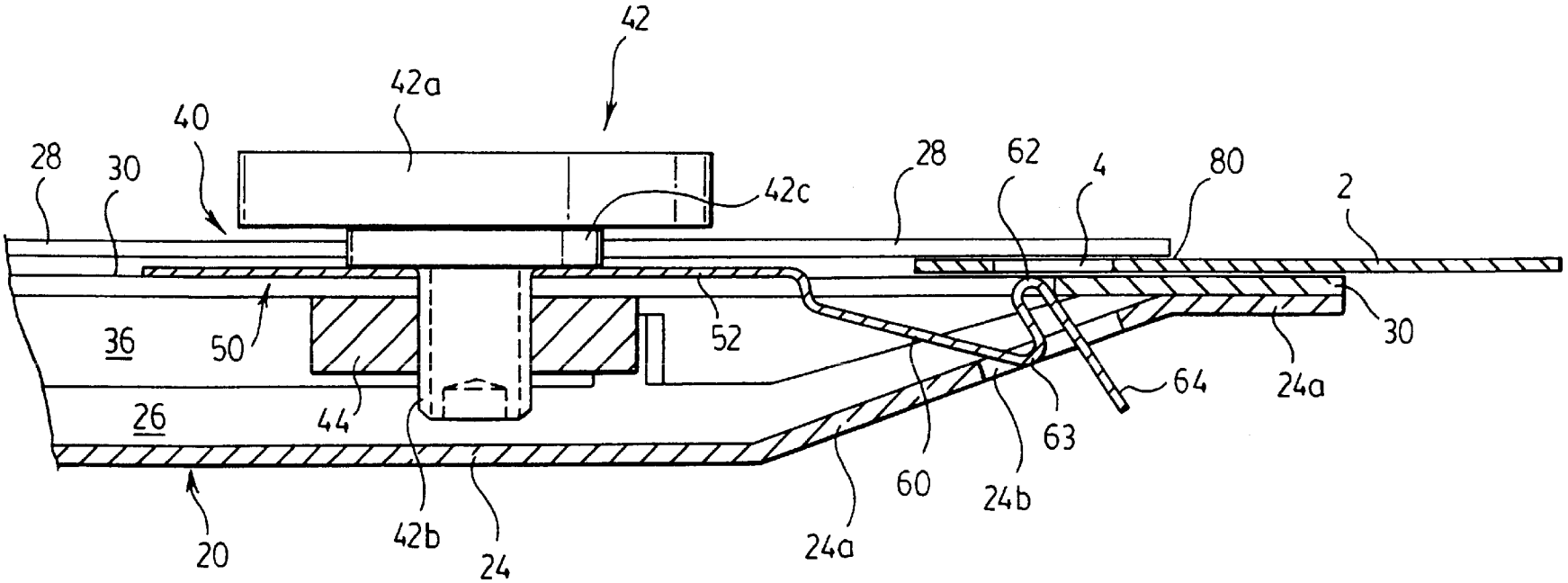
FIG. 6 is an enlarged partial cross section of the utility knife of FIG. 1 showing the blade engaging member in a release position.

As the outer segment of blade 2 dulls, the user can break off the dull segment, unlock the sliding body 40 and further extend the blade 2 to expose the next segment of blade 2, which has been protected by the handle 20 and is thus still sharp. When the last segment of the blade is dull, the user must replace the blade 2. The user rotates the rotary knob 42*a* to loosen the bolt 42 and forces the sliding body 40 toward the throat 80. As can be seen in FIG. 5, as the sliding body 40 approaches the end of the slot 38, the cam finger 64 engages the end of the slot 38. As the sliding body 40 is moved closer to the throat 80, cam finger 64 draws locking arm 60 inwardly until engaging projection 62 has receded from the hole 4 in the blade 2, as shown in FIG. 6. At this point, the blade 2 is disengaged from the sliding body 40 and can be removed from the handle 20. A new blade 2 is inserted in its place, lining up the opening 4 over the engaging projection 62. By pushing the blade 2 into the handle 20, the sliding body 40 is forced away from the throat 80 and as the cam finger 64 slides up the end of the slot 38 the resilient locking arm 60 returns to the engaging position in which the projection 62 extends through the opening 4 of the blade 2. At the point shown in FIG. 5, the new blade 2 is locked to the sliding body 40 and can be retracted into the handle 20 for use or storage.

Advantageously, the engaging projection 62 is angled away from the throat 80 (i.e. toward the sliding body 40), so that a longitudinal force pulling the blade 2 away out of the knife 10 actually draws the engaging projection 62 further through the hole 4, as the blade is pulled into the inflection portion 63, to prevent dislodgement of the blade 2.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A knife, comprising a handle, comprising an outer channel having a back surface, side surfaces and retaining flanges depending inwardly from the side surfaces, a blade supporting surface having a guide slot, spaced from the retaining flanges for slidably receiving a blade therebetween, and a sliding body trapped between the retaining flanges and the blade supporting surface, the sliding body having a locking member disposed through the guide slot for locking a position of the sliding body within the handle, and comprising a blade engaging member for engaging the blade to the sliding body, the blade engaging member comprising a body portion, and a resilient blade engaging arm projecting from the body portion, the blade engaging arm having a blade engaging projection for extending through an opening in the blade, and a cam finger extending through the guide slot, disposed between the blade engaging projection and an end of the guide slot adjacent to a throat of the knife, whereby when the sliding body is moved so that the cam finger is pressed against the end of the guide slot, the blade engaging projection recedes from the opening in the blade to disengage the blade from the sliding body.

2. The knife of claim 1 in which a portion of the back surface of the outer channel tapers toward the blade supporting surface and abuts the blade supporting surface at a throat of the knife.

3. The knife of claim 2 in which the back surface of the outer channel comprises an opening through which the cam finger extends when the blade engaging projection recedes from the opening in the blade.

4. The knife of claim 2 in which a pocket clip is affixed to an opening in the blade supporting surface and covers an end of the handle opposite the throat of the knife.

5. The knife of claim 1 in which the blade supporting surface is part of an inner channel is disposed in the outer channel.

6. The knife of claim 5 in which the inner channel is disposed in inverted relation to the outer channel.

7. The knife of claim 5 in which the locking member comprises a locking bolt extending through the sliding body and through the guide slot in the blade supporting surface and into a nut trapped between the sides of the inner channel.

8. A knife, comprising a handle, comprising an outer channel having a back surface, side surfaces and retaining flanges depending inwardly from the side surfaces, an inner channel comprising blade supporting surface and sides, the sides abutting the side surfaces of the outer channel and the blade supporting surface being spaced from the retaining flanges for slidably receiving a blade therebetween, and a sliding body for engaging the blade trapped between the retaining flanges and the blade supporting surface, the sliding body having a locking member for locking a position of the sliding body within the handle.

9. The knife of claim 1 in which the inner channel is disposed in inverted relation to the outer channel.

10. The knife of claim 9 in which a portion of the back surface of the outer channel tapers toward the blade supporting surface and abuts the blade supporting surface at a throat of the knife.

11. The knife of claim 10 in which a pocket clip is affixed to an opening in the blade supporting surface and covers an end of the handle opposite the throat of the knife.

12. The knife of claim 9 in which the locking member comprises a locking bolt extending through the sliding body and through a guide slot in the blade supporting surface and into a nut trapped between the sides of the inner channel.

13. The knife of claim 4 in which the locking member comprises a blade engaging member for engaging the blade to the sliding body, the blade engaging member comprising a body portion and a resilient blade engaging arm projecting from the body portion, the blade engaging arm having a blade engaging projection for extending through an opening in the blade, and a cam finger extending through the guide slot disposed between the blade engaging projection and an end of the guide slot adjacent to a throat of the knife, whereby when the sliding body is moved so that the cam finger is pressed against the end of the guide slot, the blade engaging projection recedes from the opening in the blade to disengage the blade from the sliding body.

14. The knife of claim 13 in which the back surface of the outer channel comprises an opening through which the cam finger extends when the blade engaging projection recedes from the opening in the blade.

* * * * *